US007047652B1

(12) United States Patent
Chipman

(10) Patent No.: US 7,047,652 B1
(45) Date of Patent: May 23, 2006

(54) ARCHERY PEEP SIGHT SYSTEM

(75) Inventor: Donald I. Chipman, Mason City, IA (US)

(73) Assignee: Specialty Archery, LLC, Spencer, IA (US)

( * ) Notice: Subject to any disclaimer, the term of this patent is extended or adjusted under 35 U.S.C. 154(b) by 0 days.

(21) Appl. No.: 10/991,058

(22) Filed: Nov. 17, 2004

(51) Int. Cl.
*F41G 1/467* (2006.01)

(52) U.S. Cl. ..... 33/265; 124/87

(58) Field of Classification Search ..... 33/265; 124/87, 90

See application file for complete search history.

(56) References Cited

U.S. PATENT DOCUMENTS

| | | | | |
|---|---|---|---|---|
| 3,410,644 | A | 11/1968 | McLendon | |
| 3,703,771 | A | 11/1972 | Saunders | |
| 4,116,194 | A * | 9/1978 | Topel | 124/87 |
| 4,552,121 | A | 11/1985 | Treaster | |
| 4,656,747 | A | 4/1987 | Troncoso | |
| 4,833,786 | A | 5/1989 | Shores | |
| 4,961,264 | A | 10/1990 | Topel | |
| 4,965,938 | A * | 10/1990 | Saunders | 33/265 |
| 5,137,007 | A | 8/1992 | Shoemake et al. | |
| 5,347,976 | A | 9/1994 | Saunders | |
| 5,669,146 | A * | 9/1997 | Beutler | 33/265 |
| 5,697,357 | A | 12/1997 | Chipman | |
| 6,058,921 | A * | 5/2000 | Lawrence et al. | 124/87 |
| 6,170,164 | B1 * | 1/2001 | Knowles | 33/265 |
| 6,397,482 | B1 * | 6/2002 | Chipman | 33/265 |

OTHER PUBLICATIONS

"Hyperopia" definition provided by "Wikipedia, the free encycclopedia" from their internet website "http://en.wikipedia.org/wiki/Hyperopia" printed on Jul. 24, 2005.*

* cited by examiner

*Primary Examiner*—R. Alexander Smith
(74) *Attorney, Agent, or Firm*—Gerald E. Helget; Briggs and Morgan, P.A.

(57) ABSTRACT

An archery peep sight system for mounting on a bow having a bowstring, a bow cable, and a front sight with front sight alignment pins. A peep sight is mounted on the bowstring. A flexible connector connects the peep sight to the bow cable, keeping the peep sight in alignment. A verifier lens is mounted within the peep sight. The verifier lens having a power to permit a far-sighted archer to focus on the front sight alignment pins while keeping the target in focus.

24 Claims, 2 Drawing Sheets

ARCHERY PEEP SIGHT SYSTEM

BACKGROUND OF THE INVENTION

The present invention relates to an archery peep sight and in particular to an archery peep sight that allows persons who are far-sighted to see the pins of the front sight.

Peep sights used in archery are well-established aiming devices contributing to the enhancement of the skills of the archer. Peep sights of the general class of the invention are mounted on the bowstring above the nocking point so that upon drawing the bowstring back the archer may align with one eye the small bore of the peep sight with a bow sight pin or with a target. The locating of a target and the sighting on a target through a constricted, small-diameter peep sight is a difficult task aggravated by the very limited field that is viewable through the peep sight. Once the target is "lost," it is difficult to relocate and to reorient the peep sight bore in registry with the intended precise field of interest. Also, even the slightest misalignment of the bore of the peep sight with a line of sight of the archer tends to render it impossible to view through the peep sight bore to sight the target.

Certain of the above problems have been addressed by U.S. Pat. Nos. 5,137,007 and 5,697,357. However, no existing peep sight allows an archer who is far-sighted to readily see the aiming pins of the front sight.

Far-sightedness is a vision problem in which the ability to see objects in the distance is normal, but objects that are close appear blurred. The eyeball is too short, or the cornea and lens are too weak, so that the image focuses behind the retina rather than on the retina. Glasses, contact lenses or corrective surgery alter the image so that the image will focus on the retina. For the archer, hyperopia or far-sightedness prevents easy focusing on the aiming pins of the front sight.

There is a need for an improved archery peep sight that addresses this problem.

Furthermore, there is a need for an archery peep sight with a hood that prevents ambient light from interfering with the archer's view of the front sight pins and the target.

SUMMARY OF THE INVENTION

An archery peep sight system for mounting on a bow having a bowstring, a bow cable, and a front sight with front sight alignment pins. A peep sight is mounted on the bowstring. A flexible connector connects the peep sight to the bow cable, keeping the peep sight in alignment. A verifier lens is mounted within the peep sight. The verifier lens having a power to permit a far-sighted archer to focus on the front sight alignment pins while keeping the target in focus.

A principal object and advantage of the present invention is that it lets a far-sighted archer see the alignment pins of the bow's front sight while still permitting the target to remain in focus.

Another principal object and advantage of the present invention is that it includes a number of lenses of different powers to accommodate the vision of various archers.

Another principal object and advantage of the present invention is that it has a hood to prevent ambient light from interfering with use of the peep sight.

DETAILED DESCRIPTION OF THE PREFERRED EMBODIMENT

Figure 1:
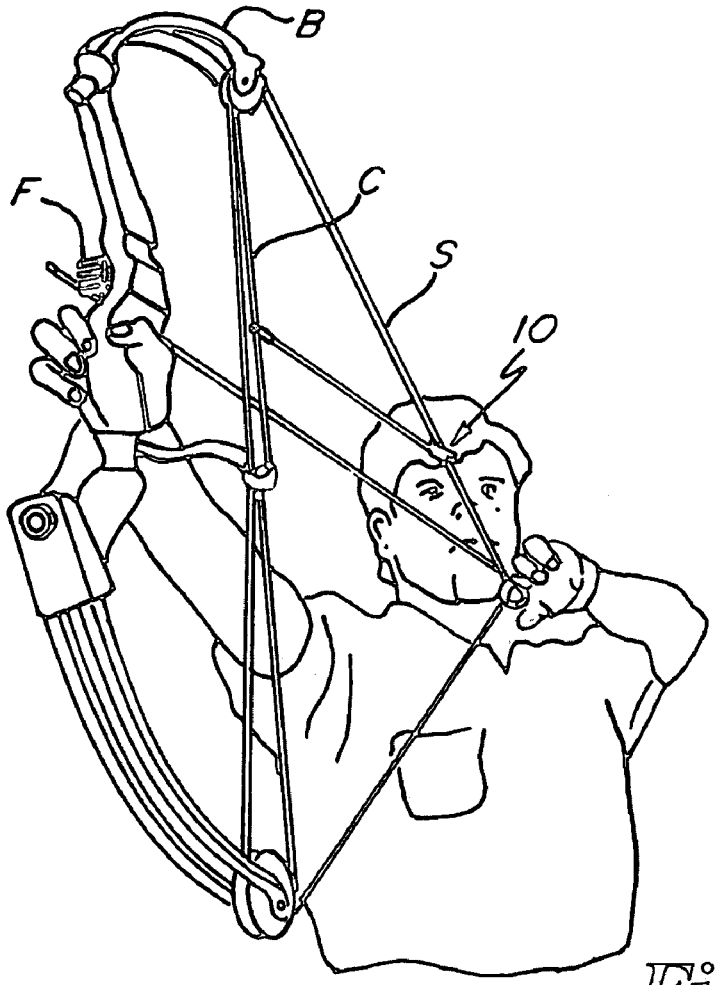
FIG. 1 is a perspective view of an archer using the present invention.
Figure 2:
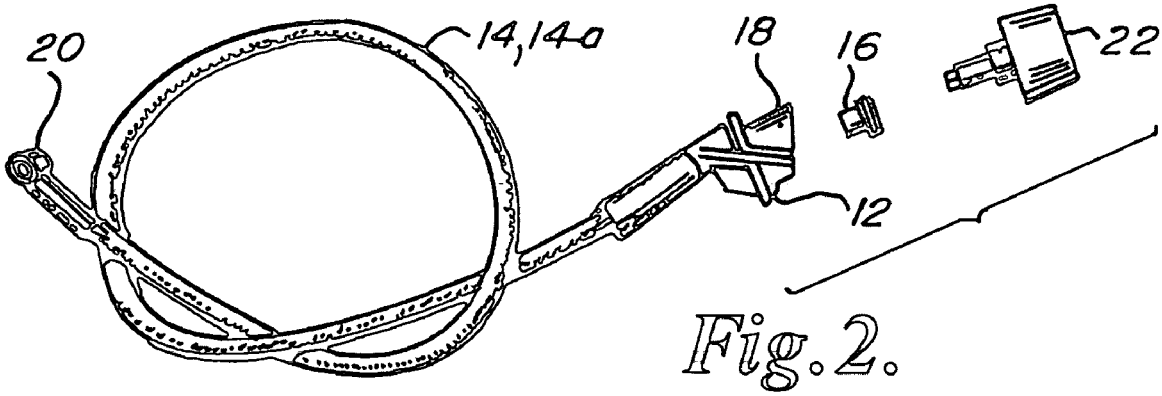
FIG. 2 is an exploded view of the parts of the present invention.
Figure 3:
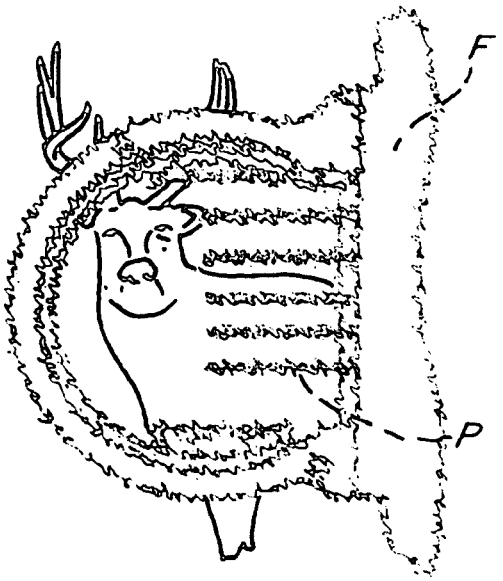
FIG. 3 is a representational view of the blurred image which a far-sighted hunter sees of the front sight pins.
Figure 4:
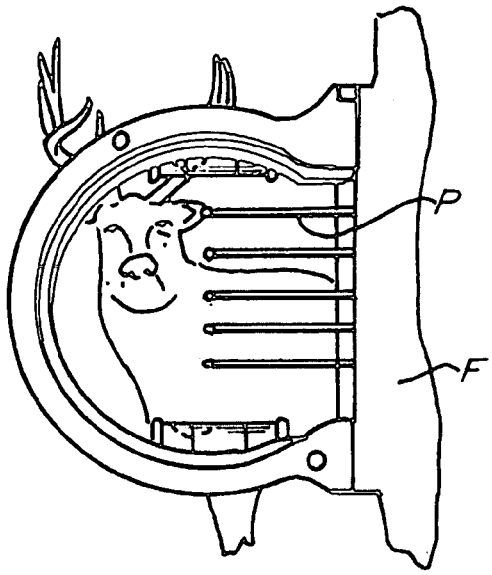
FIG. 4 is the same as FIG. 3, but with the far-sighted archer using the present invention.
Figure 5:
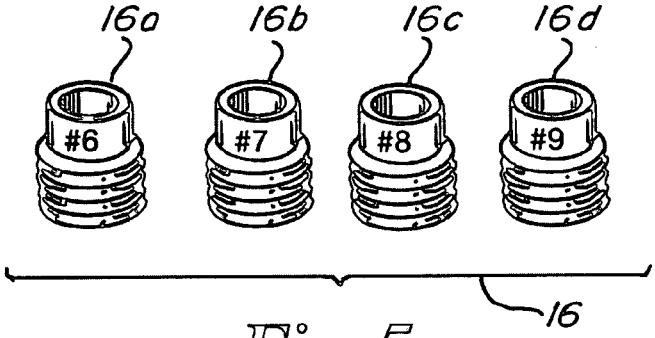
FIG. 5 is a perspective view of a number of lenses of different powers which may be used with the present invention.
Figure 6:
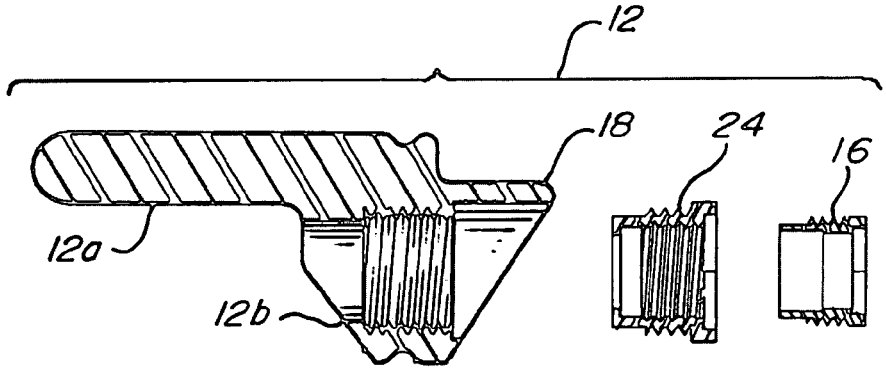
FIG. 6 is a detailed exploded view of the peep sight of the present invention with component parts, and with some structure cut away to show internal structure.

The present invention is shown in the Figures as reference numeral 10.

The archery control system 10 is adapted for mounting on a bow B having a bowstring S, a bow cable C, and a front sight F with front sight alignment pins P and comprises a peep sight 12 mounted on the bowstring S, a flexible connector 14 connecting the peep sight 12 to the bow cable C, the flexible connector 14 keeping the peep sight 12 in alignment, and a verifier lens 16 within the peep sight 12, the verifier lens 16 having a power to permit a far-sighted archer to focus on the front sight alignment pins P while keeping the target in focus.

In one embodiment, the archery control system 10 further comprises a hood 18 on the peep sight 12 adapted to prevent ambient light from interfering with the use of the peep sight 12.

Preferably, the verifier lens 16 further comprises a plurality of interchangeable lenses 16*a*, 16*b*, 16*c*, 16*d*, and so forth, of different powers. While only four lenses are shown in the Figures, it is to be understood that this is not a limit. In the preferred embodiment, the lenses are of powers of 1.00, 1.250, 150, and 1.750 diopters. The respective effective focal lengths in the preferred embodiment range from 1000.00 mm for the 1.00 diopter lens to 800.0 mm for the 1.250 diopter lens to 666.67 mm for the 1.50 diopter lens to 571.43 mm for the 1.75 diopter lens. All focal lengths are plus or minus 3%. The preferred focal lengths allow both the alignment pins and the target to remain clear. Reading glasses of the same power have a different focal length that would cause the target to become fuzzy.

The archery control system 10 further comprises a clamp 20 for connecting the flexible connector 14 to the bow cable C.

Preferably, the flexible connector 14 comprises rubber tubing 14*a*, however any other flexible material could also be used. The peep sight 12 has an extension 12*a* engaging the rubber tubing.

Preferably, the archery control system 10 further comprises a tool 22 for mounting the verifier lens 16 within the peep sight 12.

In the preferred embodiment, the peep sight body 12*b* is internally threaded and an externally threaded adapter 24 engages the peep sight body, the adapter 24 being externally threaded to mate with the peep sight body and also internally threaded to engage the verifier lens 16, which is externally threaded.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An archery peep sight system for mounting on a bow having a bowstring, a bow cable, and a front sight with at least one front sight alignment pin, comprising:

(a) a peep sight mounted on the bowstring;

(b) a flexible connector connecting the peep sight to the bow cable, the flexible connector keeping the peep sight in alignment; and (c) a verifier lens within the peep sight, the verifier lens having a power to permit a far-sighted archer to focus on the front sight alignment pins.

2. The archery peep sight system of claim 1, further comprising a hood on the peep sight adapted to prevent ambient light from interfering with the use of the peep sight.

3. The archery peep sight system of claim 1, wherein the verifier lens further comprises a plurality of interchangeable lenses of different powers.

4. The archery peep sight system of claim 1, further comprising a clamp for connecting the flexible connector to the bow cable.

5. The archery peep sight system of claim 1 wherein the flexible connector further comprises rubber tubing.

6. The archery peep sight system of claim 5, further comprising an extension on the peep sight engaging the rubber tubing.

7. The archery peep sight system of claim 1, further comprising a tool for mounting the verifier lens within the peep sight.

8. The archery peep sight system of claim 1, the peep sight body being internally threaded, and further comprising an externally threaded adapter engaging the peep sight body, the adapter being internally threaded, and the verifier lens being externally threaded to engage the threaded adapter.

9. An archery peep sight system for mounting on a bow having a bowstring, a bow cable, and a front sight with front sight alignment pins, comprising:

(a) a peep sight mounted on the bowstring;

(b) a flexible connector connecting the peep sight to the bow cable, the flexible connector keeping the peep sight in alignment;

(c) a verifier lens within the peep sight, the verifier lens having a power to permit a far-sighted archer to focus on the front sight alignment pins; and (d) wherein the verifier lens further comprises a plurality of interchangeable lenses of different powers.

10. The archery peep sight system of claim 9, further comprising a clamp for connecting the flexible connector to the bow cable.

11. The archery peep sight system of claim 9 wherein the flexible connector further comprises rubber tubing.

12. The archery peep sight system of claim 11, further comprising an extension on the peep sight engaging the rubber tubing.

13. The archery peep sight system of claim 9, further comprising a tool for mounting the verifier lens within the peep sight.

14. The archery peep sight system of claim 9, the peep sight body being internally threaded, and further comprising an externally threaded adapter engaging the peep sight body, the adapter being internally threaded, and the verifier lens being externally threaded to engage the threaded adapter.

15. An archery peep sight system for mounting on a bow having a bowstring, a bow cable, and a front sight with front sight alignment pins, comprising:

(a) a peep sight mounted on the bowstring;

(b) a flexible connector connecting the peep sight to the bow cable, the flexible connector keeping the peep sight in alignment;

(c) a verifier lens within the peep sight, the verifier lens having a power to permit a far-sighted archer to focus on the front sight alignment pins;

(d) wherein the verifier lens further comprises a plurality of interchangeable lenses of different powers; and (e) further comprising a hood on the peep sight adapted to prevent ambient light from interfering with the use of the peep sight.

16. The archery peep sight system of claim 15, further comprising a clamp for connecting the flexible connector to the bow cable.

17. The archery peep sight system of claim 15, wherein the flexible connector further comprises rubber tubing.

18. The archery peep sight system of claim 17, further comprising an extension on the peep sight engaging the rubber tubing.

19. The archery peep sight system of claim 15, further comprising a tool for mounting the verifier lens within the peep sight.

20. The archery peep sight system of claim 15, the peep sight body being internally threaded, and further comprising an externally threaded adapter engaging the peep sight body, the adapter being internally threaded, and the verifier lens being externally threaded to engage the threaded adapter.

21. The archery peep sight system of claim 15, wherein the lens powers are in the range of about 1.00 diopter to about 1.75 diopter.

22. An archery peep sight system for mounting on a bow having a bowstring, a bow cable, and a front sight with at least a front sight alignment pin, comprising a peep sight being used to focus on a target, a verifier lens with the peep sight having a positive diopter power enabling a far-sighted archer to focus on the front alignment pins while keeping the target in focus.

23. The verifier lens of claim 22, wherein the power of the verifying lens is in the range of about 1.00 diopter to about 1.75 diopter.

24. The verifier lens of claim 22, further comprising a plurality of interchangeable lenses with powers ranging from about 1.00 diopter to about 1.75 diopter.

* * * * *